US005399818A

United States Patent [19]

Golbeck et al.

[11] Patent Number: 5,399,818

[45] Date of Patent: Mar. 21, 1995

[54] BATTERY MASTER SWITCH

[75] Inventors: Bernard J. Golbeck; John J. Golbeck, both of Crystal Lake, Ill.

[73] Assignee: GAMA Electronics, Inc., Crystal Lake, Ill.

[21] Appl. No.: 147,339

[22] Filed: Nov. 3, 1993

[51] Int. Cl.[6] ..... H01H 3/40; H01H 35/00

[52] U.S. Cl. ..... 200/52 R; 200/507

[58] Field of Search ..... 200/52 R, 61, 44, 507; 439/737, 741

[56] References Cited

U.S. PATENT DOCUMENTS 2,145,041 1/1939 Childers ..... 200/507

3,287,532 11/1966 Boseley ..... 200/52 R X

*Primary Examiner*—J. R. Scott

*Attorney, Agent, or Firm*—Dorn, McEachran, Jambor & Keating

[57] ABSTRACT

A battery switch has two identical, nested terminals separated by an insulator and having aligned openings for receiving a connecting bolt. The bolt when installed in the openings provides electrical connection between the terminals. Each terminal has a lug for connection to a battery cable or post, an extension portion attached to the lug and a receptacle for receiving the extension portion of the other terminal. The extension is offset from a central plane so the two terminals fit together along the central plane in a low profile configuration. The interfitting extensions and receptacles lock the terminals together.

10 Claims, 1 Drawing Sheet

BATTERY MASTER SWITCH

BACKGROUND OF THE INVENTION

This invention relates to a battery master switch of the type typically used in automotive or vehicular applications. It is used to disconnect the vehicle battery from the rest of the electrical circuit without removing the battery cables from the battery posts or terminals. Sometimes it is necessary to disconnect the vehicle battery from the rest of the electrical system while doing maintenance or repair work. While this can be done by disconnecting the battery cables from the posts, such disconnection can be troublesome because access to the posts is often limited, especially with side-mounted battery posts. Furthermore, disconnecting the cables requires a wrench and cannot be done quickly. A battery master switch is used to connect and disconnect the battery quickly without the need for any tools. The master switch also provides some anti-theft benefit because removal of the connecting bolt disables the electrical system entirely.

A known master switch for conventional top post batteries has a clamp member bolted to the battery post with an integral socket extending from the clamp member. A separate blade fits into the socket, separated therefrom by an insulator. The sides of the socket are crimped around the blade to hold the two pieces together. A lug joins the blade to provide a connecting point for the battery cable. A bolt hole extends through the socket, blade and insulator. A bolt with a knob extends through the hole. When the bolt is fully seated in the hole, it provides electrical connection between the blade and socket, thereby completing a circuit to the battery. Backing the bolt partially out of the hole breaks the circuit and disconnects the battery.

While the known battery master switch is serviceable, it is not suitable for use with batteries with side-mounted posts because of the high profile of the switch. The prior switch also is not as cost efficient as possible due to the number of distinct parts it requires. Manufacture of the switch requires a heavy-duty crimping operation to hold the socket and blade together. The present invention alleviates these drawbacks of the prior construction.

SUMMARY OF THE INVENTION

This invention relates to a battery master switch which is suitable for use on batteries having its posts or terminals on the side. The switch has several advantages over prior art switches. Among these are a-low profile design, a reduced number of parts required to make the switch and the durability of the physical connection between the switch parts, with or without the connector bolt in place.

The battery switch of the present invention comprises a first terminal which includes a lug ending at a transverse wall, a floor extending from the transverse wall and a pair of posts extending from the floor. The floor, posts and transverse wall define a first enclosure. There is a bolt hole or opening through the floor. A second terminal is provided which is substantially identical in construction to the first terminal. The floor of the second terminal is arranged in overlapping relation with the floor of the first terminal such that the floor of each terminal extends into the enclosure of the other. Also, the overlapping terminals have their openings axially aligned. An insulator is interposed between the terminal floors to electrically isolate the terminals. The insulator has an opening aligned with the terminal openings. A connector bolt is insertable into the aligned openings to electrically connect the terminals. Backing the bolt out of the openings breaks the electrical circuit between the terminals.

DETAILED DESCRIPTION OF THE INVENTION

Figure 1:
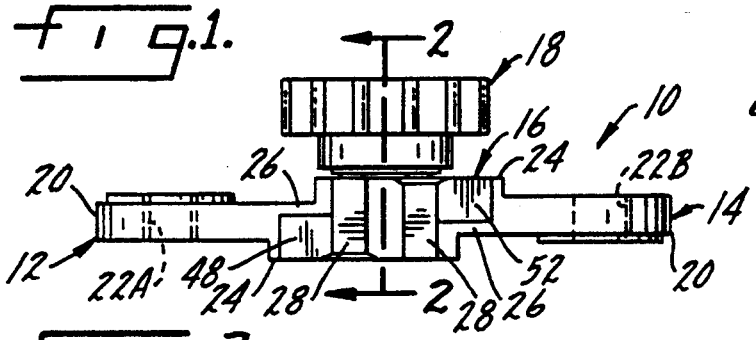
FIG. 1 is a side elevation view of the switch of the present invention.
Figure 2:
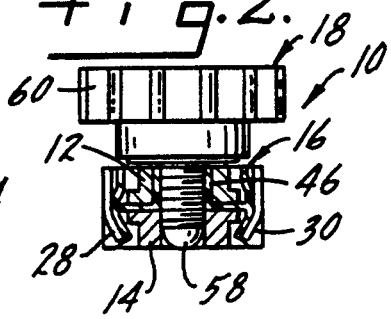
FIG. 2 is a section taken along line 2—2 of FIG. 1.
Figure 3:
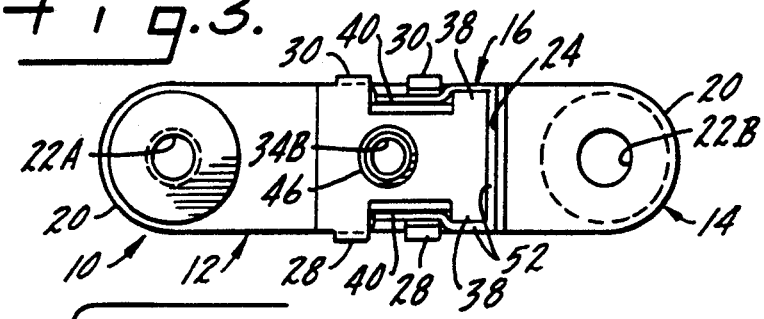
FIG. 3 is a top plan view of the switch with the connector bolt removed to show the underlying parts.

FIGS. 1–3 show the assembled battery master switch 10 according to the present invention. The switch has four main parts, a first terminal 12, a second terminal 14, an insulator 16 disposed between the terminals and a connector bolt 18. The first and second terminals 12 and 14 are substantially identical parts. The only differences are the diameters of various openings and the presence or absence of threads in those openings. Thus, only one basic terminal piece needs to be fabricated; the differences between the two terminals are simply matters of machining. This reduces the number of basic parts needed to produce the switch, thus affording significant cost savings over prior switches.

Figure 5:
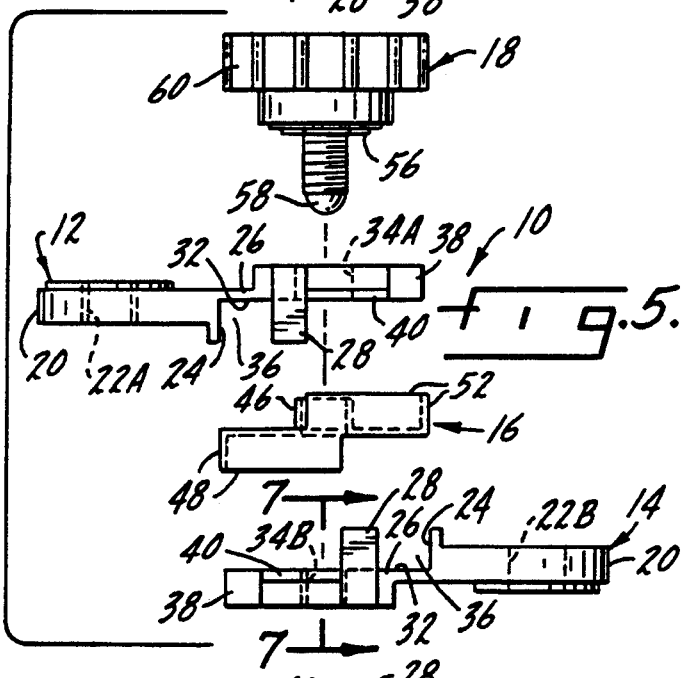
FIG. 5 is an exploded side elevation view of the switch.
Figure 6:
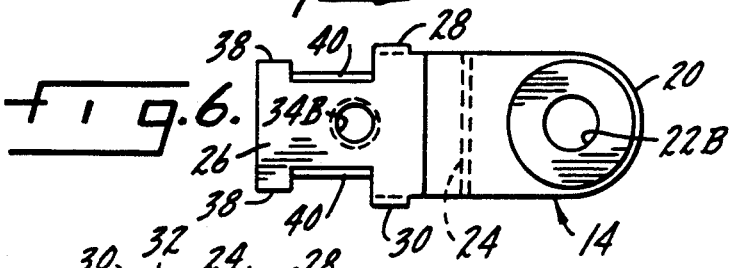
FIG. 6 is a bottom plan view of a terminal.
Figure 7:
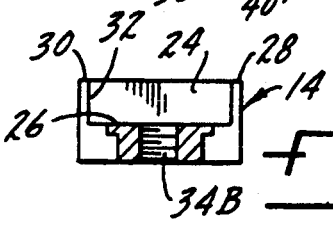
FIG. 7 is a section through a terminal taken along line 7—7 of FIG. 5.

Details of the terminals are best seen in FIG. 5–7. Since they are substantially identical, only one of the terminals will be described with like parts given common reference numerals for the two terminals 12 and 14. The terminal has a body portion including a lug 20 with a bore therethrough. The lug and bore serve as a connecting point for either the battery cable or the battery terminal. Bore 22A in terminal 12 is threaded to accept a bolt (not shown) of a cable connector. Bore 22B in terminal 14 is somewhat larger than bore 22A and is simply a through hole which receives a bolt (not shown) for attachment to the battery post or terminal. The terminals 12 and 14 are made of electrically conductive metal such as ZAMAK #3.

The inner portion of the lug 20 ends at a transverse wall 24. A planar floor 26 extends generally longitudinally from the transverse wall 24. A pair of posts 28 and 30 extend perpendicularly from the floor 26. The floor 26, posts 28, 30 and transverse wall 24 define a first enclosure, indicated at 32.

There is an opening through the floor 26. Opening 34A in terminal 12 is not threaded and has a diameter larger than that of the connector bolt shank. Thus, the bolt will slip unimpeded through opening 34A. Opening 34B in terminal 14 on the other hand has threads which engage the threads of bolt 18.

It will be noted that the lug 20 defines a central plane and the floor 26 extends parallel to and offset from the central plane. Thus, when two terminals are placed in facing relation (see FIG. 5), the floors 26 of the two terminals are on complementary sides of the central plane and the planes of the two lugs 20 coincide. With the terminals thus disposed in overlapping relation the floor 26 of each terminal extends into the enclosure 32 of the other and the openings 34A, 34B of the terminals are axially aligned.

It will be further noted that the posts 28, 30 are longitudinally spaced from the transverse wall 24, thereby forming gaps 36 at the corners of the enclosure 32. Also, the floor 26 has transverse extensions 38 at the ends thereof. The purpose of the gaps and extensions will be explained below. Between the extensions 38 and the posts 28, 30 the floor 26 has a notched portion 40.

Figure 8:
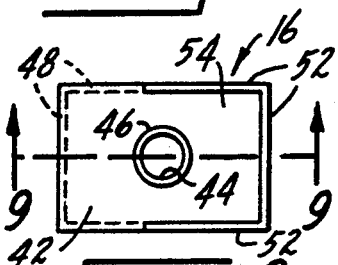
FIG. 8 is a top plan view of the insulator.
Figure 9:
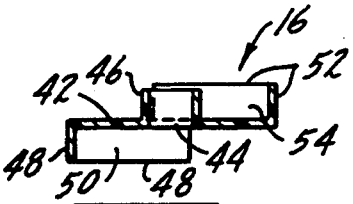
FIG. 9 is a section through the insulator taken along line 9—9 of FIG. 8.
Figure 10:
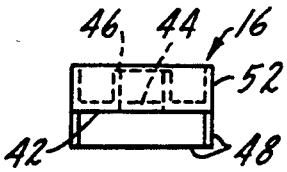
FIG. 10 is an end elevation view of the insulator.

Details of the insulator 16 are shown in FIGS. 8–10. The insulator is made of a non-conductive plastic material such as Zytel 101. The insulator has a base member 42 having an opening 44 aligned with the terminal openings 34A,34B. An upstanding cylindrical sleeve 46 surrounds the opening 44. First upstanding walls 48 surround a portion of the periphery of the base on one side thereof. The walls 48 define a first pocket 50 on one side of the base member 42. Second upstanding walls 52 surround a portion of the periphery of the base on the other side and define a second pocket 54 on the opposite side of the base member.

When the insulator is in position in an assembled switch, it is interposed between the terminal floors to electrically isolate the terminals, as best seen in FIG. 5. The sleeve 46 fits into opening 34A. The first pocket 50 is disposed at least partially within the enclosure 32 of the first terminal 12 and the second pocket 54 is disposed at least partially within the enclosure of the second terminal. The extensions 38 at the ends of the floor are disposed within pockets 50, 54 and urge the upstanding walls 48 or 52 into the gaps 36. This causes the walls to flex or bulge slightly around the posts 28, 30, thereby interlocking the extensions of one terminal with the posts of the other terminal (see FIG. 3). Note also that the upstanding walls of the pockets terminate adjacent the posts at the notched portion 40. The posts 28, 30 are bent or swaged over as best seen in FIG. 2.

Figure 4:
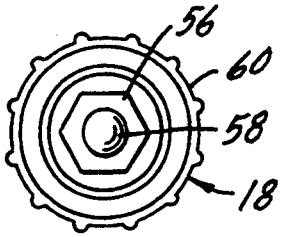
FIG. 4 is a bottom plan view of the connector bolt.

The connector bolt 18 is shown in FIGS. 2 and 4. The bolt has a hexagonal head 56 attached to a threaded shank 58. The head and shank are made of brass or other suitable metal. The head is insert-molded or otherwise fixed to a plastic knob 60. The knob allows a user to easily manipulate the bolt. When fully inserted the head 56 contacts floor 26 of terminal 12 while the threads of shank 58 engage the threads of opening 34B to complete an electrical path through the switch. Backing the knob out of the openings breaks contact between the head and floor and interrupts the circuit. It will be noted that the insulator sleeve 46 lines the opening 34A to prevent inadvertent contact between shank 58 and terminal 12.

While a preferred embodiment of the invention has been shown and described it will be realized that alterations may be made thereto without departing from the scope of the following claims.

We claim:

1. A battery switch, comprising:

a first terminal having a body portion which includes a lug ending at a transverse wall, a floor extending from the transverse wall, a pair of posts extending from the floor, and an opening through the floor, the floor, posts and transverse wall defining a first enclosure;

a second terminal substantially identical in construction to the first terminal with the floor, posts and transverse wall defining a second enclosure, the floor of the second terminal being disposed in overlapping relation with the floor of the first terminal such that the floor of each terminal extends into the enclosure of the other and the openings of the terminals are axially aligned;

an insulator interposed between the terminal floors to electrically isolate the terminals, the insulator having a base member having an opening aligned with the terminal openings; and a connector bolt insertable in and engageable with the aligned openings to electrically connect the terminals when the bolt is placed in the openings.

2. The battery switch of claim 1 further characterized in that the insulator has first upstanding walls forming a first pocket on one side of the base member and second upstanding walls forming a second pocket on the opposite side of the base member, the first pocket being disposed at least partially within the first enclosure and the second pocket being disposed at least partially within the second enclosure.

3. The battery switch of claim 2 further characterized in that the posts are longitudinally spaced from the transverse wall forming gaps at the corners of the enclosures, and the floors have transverse extensions at the ends thereof which urge the upstanding walls of the pockets into the gaps, thereby interlocking the extensions of one terminal with the posts of the other terminal.

4. The battery switch of claim 2 further characterized in that the floor has a notched portion adjacent the posts and the upstanding walls of the pockets terminate adjacent the posts at the notched portion.

5. The battery switch of claim 1 further characterized in that the lug defines a central plane and the floor extends parallel to and offset from said plane such that when placed in facing relation the terminal floors are on complementary sides of the central plane.

6. The battery switch of claim 1 wherein the insulator extends at least partially into one of the terminal's openings.

7. A battery switch, comprising:

first and second substantially similar, overlapping terminals each having an opening, an enclosure and an extension portion which fits into the enclosure of the other;

an insulator interposed between the terminals to electrically isolate them, the insulator having first and second pockets on opposite sides of the insulator, each pocket fitting into the enclosure of one of the terminals and receiving the extension portion of the other terminal, the insulator further including an opening aligned with the terminal openings; and a connector bolt insertable in and engageable with the aligned openings to electrically connect the terminals when the bolt is placed in the openings.

8. The battery switch of claim 7 further characterized in that the insulator has a base member and first upstanding walls forming the first pocket on one sidle of the base member and second upstanding walls forming the second pocket on the opposite side of the base member.

9. The battery switch of claim 8 further characterized in that each terminal has a body portion which includes a lug ending at a transverse wall, a floor extending from the transverse wall having an opening therein, and a pair of posts extending from the floor, the floor, posts and transverse wall defining the enclosure.

10. The battery switch of claim 9 further characterized in that the posts are longitudinally spaced from the transverse wall so as to form gaps at the corners of the enclosures, and the floors have transverse extensions at the ends thereof which urge the upstanding walls of the pockets into the gaps, thereby interlocking the extensions of one terminal with the posts of the other terminal.

* * * * *